US007669348B2

(12) United States Patent
Christy et al.

(10) Patent No.: US 7,669,348 B2
(45) Date of Patent: Mar. 2, 2010

(54) APPARATUS, METHOD AND SYSTEM FOR TREATING SEWAGE SLUDGE

(75) Inventors: Richard W. Christy, Eagleville, PA (US); Robert Van Bramer, Sanatoga, PA (US); Michael Quici, Ambler, PA (US)

(73) Assignee: RDP Company, Norristown, PA (US)

( * ) Notice: Subject to any disclaimer, the term of this patent is extended or adjusted under 35 U.S.C. 154(b) by 551 days.

(21) Appl. No.: 11/539,903

(22) Filed: Oct. 10, 2006

(65) Prior Publication Data

US 2008/0083133 A1 Apr. 10, 2008

(51) Int. Cl.
*F26B 7/00* (2006.01)

(52) U.S. Cl. ..... 34/361; 34/443; 34/514; 34/90; 34/135; 34/137; 210/609; 210/739; 177/132; 110/246

(58) Field of Classification Search ..... 34/361, 34/443, 514, 90, 135, 137; 210/609, 739; 110/246; 177/132
See application file for complete search history.

(56) References Cited

U.S. PATENT DOCUMENTS 2,015,050 A * 9/1935 Baird et al. ..... 110/225
2,090,363 A * 8/1937 Wendeborn ..... 106/754
2,094,152 A * 9/1937 Granger ..... 110/226
2,119,601 A * 6/1938 Raisch ..... 110/225
2,723,954 A * 11/1955 Young ..... 34/347
2,954,285 A * 9/1960 Carlsson et al. ..... 71/9
3,073,708 A * 1/1963 Kroyer ..... 106/489
3,165,462 A * 1/1965 Gallagher et al. ..... 208/86
3,194,492 A * 7/1965 Koffinke et al. ..... 494/1
3,285,732 A * 11/1966 Schulze ..... 71/9
3,381,637 A * 5/1968 Farrell, Jr. et al. ..... 110/186
3,545,977 A * 12/1970 Stahler ..... 426/641
3,579,320 A * 5/1971 Pesses ..... 71/9
3,724,091 A * 4/1973 Rousselet ..... 34/58
3,756,784 A * 9/1973 Pittwood ..... 422/194
4,028,087 A * 6/1977 Schultz et al. ..... 71/25
4,064,744 A * 12/1977 Kistler ..... 73/766
4,119,741 A * 10/1978 Stahler ..... 426/641
4,134,731 A * 1/1979 Houser ..... 435/290.1
4,137,029 A * 1/1979 Brooks ..... 425/222
4,166,997 A * 9/1979 Kistler ..... 338/5
4,177,575 A * 12/1979 Brooks ..... 34/392
4,203,376 A * 5/1980 Hood ..... 110/346
4,245,570 A * 1/1981 Williams ..... 110/238
4,264,352 A * 4/1981 Houser ..... 71/9
4,270,470 A * 6/1981 Barnett et al. ..... 110/346
4,321,150 A * 3/1982 McMullen ..... 210/769
4,321,151 A * 3/1982 McMullen ..... 210/769

(Continued)

*Primary Examiner*—Stephen M. Gravini
(74) *Attorney, Agent, or Firm*—Paul & Paul

(57) ABSTRACT

An apparatus, method and system is provided for treating sewage sludge by heating the same in a container to drive off pathogens and/or pasteurize the sewage sludge while the material is tumbled in the container and with moisture gases being evaporated therefrom and drawn off from the container. After treatment the treated sludge is discharged from the container. There is provided at least one weight-responsive member on which the container is mounted, and a control is provided connected to the one or more weight-responsive member whereby the solids content of the treated material can be determined by measuring the difference in weight of material in the container, before and after moisture is drawn off from the material and prior to its discharge from the drum. The control is preferably effected by means of a computer.

49 Claims, 5 Drawing Sheets

Fig.4

U.S. PATENT DOCUMENTS

| | | | | | |
|---|---|---|---|---|---|
| 4,429,643 | A | * | 2/1984 | Mulholland | 110/238 |
| 4,454,770 | A | * | 6/1984 | Kistler | 73/862.633 |
| 4,544,477 | A | * | 10/1985 | Taylor | 208/424 |
| 4,581,009 | A | * | 4/1986 | Kramer | 494/37 |
| 4,586,659 | A | * | 5/1986 | Easter, II | 241/23 |
| 4,692,248 | A | * | 9/1987 | Stannard et al. | 210/403 |
| 4,711,041 | A | * | 12/1987 | Ullum | 34/179 |
| 4,712,312 | A | * | 12/1987 | Christodoulou | 34/593 |
| 4,753,181 | A | * | 6/1988 | Sosnowski | 588/321 |
| 4,824,257 | A | * | 4/1989 | List et al. | 366/99 |
| 4,828,577 | A | * | 5/1989 | Markham et al. | 44/589 |
| 4,926,764 | A | * | 5/1990 | van den broek | 110/221 |
| 4,956,002 | A | * | 9/1990 | Egarian | 71/9 |
| 4,970,803 | A | * | 11/1990 | Keller | 34/371 |
| 4,982,514 | A | * | 1/1991 | Ullum | 34/183 |
| 5,013,458 | A | * | 5/1991 | Christy et al. | 405/129.27 |
| 5,041,207 | A | * | 8/1991 | Harrington et al. | 208/131 |
| 5,067,254 | A | * | 11/1991 | Linkletter et al. | 34/137 |
| 5,085,443 | A | * | 2/1992 | Richards | 277/412 |
| 5,186,840 | A | * | 2/1993 | Christy et al. | 210/709 |
| 5,197,205 | A | * | 3/1993 | Spada et al. | 34/182 |
| 5,206,173 | A | * | 4/1993 | Finn | 435/290.1 |
| 5,207,176 | A | * | 5/1993 | Morhard et al. | 110/246 |
| 5,215,670 | A | * | 6/1993 | Girovich | 210/770 |
| 5,229,011 | A | * | 7/1993 | Christ et al. | 405/129.27 |
| 5,263,267 | A | * | 11/1993 | Buttner et al. | 34/519 |
| 5,283,961 | A | * | 2/1994 | Gobel | 34/136 |
| 5,297,957 | A | * | 3/1994 | Brashears | 432/14 |
| 5,302,179 | A | * | 4/1994 | Wagner | 71/13 |
| 5,313,022 | A | * | 5/1994 | Piroozmandi et al. | 177/211 |
| 5,365,676 | A | * | 11/1994 | Bein | 34/424 |
| 5,405,536 | A | * | 4/1995 | Christy | 210/710 |
| 5,426,866 | A | * | 6/1995 | Rumocki | 34/321 |
| 5,428,906 | A | * | 7/1995 | Lynam et al. | 34/379 |
| 5,433,844 | A | * | 7/1995 | Christy | 210/149 |
| RE35,251 | E | * | 5/1996 | van den Broek | 110/221 |
| 5,525,239 | A | * | 6/1996 | Duske | 210/739 |
| 5,540,836 | A | * | 7/1996 | Coyne | 210/221.2 |
| 5,554,279 | A | * | 9/1996 | Christy | 210/149 |
| 5,555,823 | A | * | 9/1996 | Davenport | 110/346 |
| 5,557,873 | A | * | 9/1996 | Lynam et al. | 34/379 |
| 5,561,917 | A | * | 10/1996 | Ratajczek | 34/384 |
| 5,618,442 | A | * | 4/1997 | Christy | 210/742 |
| 5,637,221 | A | * | 6/1997 | Coyne | 210/608 |
| 5,681,481 | A | * | 10/1997 | Christy et al. | 210/723 |
| 5,746,983 | A | * | 5/1998 | Stephansen | 422/162 |
| 5,770,823 | A | * | 6/1998 | Piroozmandi | 177/1 |
| 5,960,559 | A | * | 10/1999 | Brunnmair et al. | 34/514 |
| 5,964,045 | A | * | 10/1999 | Numrich | 34/408 |
| 5,966,838 | A | * | 10/1999 | Krebs et al. | 34/479 |
| 6,006,440 | A | * | 12/1999 | Wiesenhofer et al. | 34/305 |
| 6,058,619 | A | * | 5/2000 | Krebs et al. | 34/79 |
| 6,161,305 | A | * | 12/2000 | Maier et al. | 34/315 |
| 6,163,980 | A | * | 12/2000 | Van Poppel et al. | 34/356 |
| 6,193,643 | B1 | * | 2/2001 | Larsson | 494/26 |
| 6,216,610 | B1 | * | 4/2001 | Brunnmair et al. | 110/213 |
| 6,256,902 | B1 | * | 7/2001 | Flaherty et al. | 34/379 |
| 6,287,363 | B1 | * | 9/2001 | Grunbacher et al. | 75/500 |
| 6,401,636 | B2 | * | 6/2002 | Brunnmair et al. | 110/346 |
| 6,553,924 | B2 | * | 4/2003 | Beaumont et al. | 110/238 |
| 6,618,956 | B1 | * | 9/2003 | Schilp et al. | 34/58 |
| 6,618,957 | B2 | * | 9/2003 | Novak et al. | 34/264 |
| 6,692,544 | B1 | * | 2/2004 | Grillenzoni | 44/589 |
| 6,754,978 | B1 | * | 6/2004 | Adams et al. | 34/361 |
| 6,787,245 | B1 | * | 9/2004 | Hayes | 428/480 |
| 6,913,671 | B2 | * | 7/2005 | Bolton et al. | 159/16.2 |
| 6,919,027 | B2 | * | 7/2005 | Wallin et al. | 210/613 |
| 6,966,983 | B1 | * | 11/2005 | McWhirter et al. | 210/150 |
| 7,024,796 | B2 | * | 4/2006 | Carin et al. | 34/363 |
| 7,024,800 | B2 | * | 4/2006 | Carin et al. | 34/576 |
| D524,825 | S | * | 7/2006 | Koch et al. | D15/21 |
| 7,083,728 | B2 | * | 8/2006 | Lane et al. | 436/501 |
| 7,144,632 | B2 | * | 12/2006 | Hayes | 428/423.7 |
| 7,144,972 | B2 | * | 12/2006 | Hayes | 528/272 |
| 7,193,029 | B2 | * | 3/2007 | Hayes | 528/293 |
| 7,220,815 | B2 | * | 5/2007 | Hayes | 528/272 |
| 7,358,325 | B2 | * | 4/2008 | Hayes | 528/293 |
| 7,431,834 | B2 | * | 10/2008 | Shimamura et al. | 210/194 |
| 7,452,927 | B2 | * | 11/2008 | Hayes | 523/223 |
| 7,455,704 | B2 | * | 11/2008 | Garwood | 44/589 |
| 2001/0015160 | A1 | * | 8/2001 | Brunnmair et al. | 110/346 |
| 2002/0046474 | A1 | * | 4/2002 | Novak et al. | 34/259 |
| 2002/0050236 | A1 | * | 5/2002 | Beaumont et al. | 110/238 |
| 2004/0024102 | A1 | * | 2/2004 | Hayes et al. | 524/445 |
| 2004/0254332 | A1 | * | 12/2004 | Hayes | 528/296 |
| 2005/0027098 | A1 | * | 2/2005 | Hayes | 528/272 |
| 2005/0142250 | A1 | * | 6/2005 | Garwood | 426/35 |
| 2005/0171250 | A1 | * | 8/2005 | Hayes | 524/47 |
| 2005/0274669 | A1 | * | 12/2005 | Marchesseault et al. | 210/605 |
| 2006/0009609 | A1 | * | 1/2006 | Hayes | 528/272 |
| 2006/0009610 | A1 | * | 1/2006 | Hayes | 528/272 |
| 2006/0009611 | A1 | * | 1/2006 | Hayes | 528/272 |
| 2006/0010712 | A1 | * | 1/2006 | Carin et al. | 34/443 |
| 2006/0101881 | A1 | * | 5/2006 | Carin et al. | 71/21 |
| 2006/0243648 | A1 | * | 11/2006 | Shain et al. | 210/175 |
| 2006/0254079 | A1 | * | 11/2006 | Gorbell et al. | 34/363 |
| 2006/0254080 | A1 | * | 11/2006 | Carin et al. | 34/363 |
| 2007/0179673 | A1 | * | 8/2007 | Phillips et al. | 700/271 |
| 2007/0241041 | A1 | * | 10/2007 | Shimamura et al. | 210/197 |
| 2008/0083133 | A1 | * | 4/2008 | Christy et al. | 34/378 |
| 2008/0083675 | A1 | * | 4/2008 | Christy et al. | 210/766 |
| 2008/0105019 | A1 | * | 5/2008 | Carin et al. | 71/15 |
| 2008/0172899 | A1 | * | 7/2008 | Carin et al. | 34/90 |
| 2008/0189979 | A1 | * | 8/2008 | Zhou | 714/48 |
| 2008/0216346 | A1 | * | 9/2008 | Fernando et al. | 34/418 |
| 2008/0229610 | A1 | * | 9/2008 | Ronning | 34/514 |

* cited by examiner

APPARATUS, METHOD AND SYSTEM FOR TREATING SEWAGE SLUDGE

BACKGROUND OF THE INVENTION

It is known in the art of processing sewage sludge to render the sludge safe and sanitary, by various techniques a number of which have been approved by the Environmental Protection Agency EPA, which agency has developed regulations for proper treatment and disposal of sewage sludge.

The goal of treating sewage sludge is to neutralize pathogens to an environmentally safe level and to reduce vector attractiveness; i.e., to make the sewage sludge unattractive to rats, mice, flies, etc.

Various apparatus and methods for killing pathogens and reducing vector attractiveness have been developed some of which are set forth in U.S. Pat. Nos. 5,013,458; 5,229,011; 5,186,840; 5,405,536; 5,433,844; 5,554,279; and 5,681,48, the complete disclosures of all of which are herein incorporated by reference.

Previous developments in the treatment of sewage sludge have sought to inexpensively stabilize the sludge through lime addition. These systems sometimes produced objectionable odors, dust and steam while producing an end product that was of a pastey consistency and therefore difficult to handle often requiring special specialized spreading equipment, for spreading the resultant treated waste on land. Additionally, in accordance with some existing systems, the objectionable odors, particularly ammonia, are, in part, a junction of the heated sewage sludge.

In accordance with the existing developed technology, drying apparatus of various forms have been used to stabilize sewage sludge and produce a granular end product that appeared to be satisfactory, but was so extremely dry, for example in excess of 90% dry solids, such that the end product was often dusty and difficult to handle. because such processes and equipment lacked the ability to determine the solids concentration with a degree of precision, in that they simply evaporated water until the product became very dry.

Furthermore, some existing processes and equipment tend to operate on a batch basis, in which the treatment container would be filled, and the treated material then drawn off, out of the container. Typically the container would be loaded until it became essentially full, and then rotors within the container, which would be fully submerged in the material operated to mix or tumble the material such that heat from the heated rotors would come in contact with the material. However, as moisture became drawn off by the heat applied, generally from the rotors within the container the volume of the material being processed in the batch became reduced, with a result that less of the rotors became in contact with the material that was being processed. Because the efficiency of such an operation is in large part a function of the heated surface area that comes into contact with the material that is being processed, the result is that as the volume of material in the batch processing container is being reduced, the surface area that is in contact with the material being processed is likewise reduced, causing a corresponding reduction in the rate of evaporation of the liquid, principally water, that is a component of the sludge that is being processed.

Additionally, current apparatus and processes that are in use often estimate the moisture content of the final product in an indirect manner, using indirect measurements or timers. Consequently, the material being processed is dried until the temperature of the medium providing the heat increases substantially, providing an indication that all of the moisture has been removed from the product. Thus, in such processes and equipment, the processing of the batch is then considered to be complete, although it can be extremely dry and difficult to handle.

SUMMARY OF THE INVENTION

The present invention provides an apparatus, process and system for thermal stabilization of sewage sludge, with moisture reduction to produce an end product having a solids concentration that is predetermined, generally between 10% and 99% solids, with the option of lime treatment or treatment by other chemical additives.

Accordingly it is an object of this invention to provide an apparatus, process and system for treating sewage sludge by drying and/or other chemical treatment, such as lime addition or the like, in which the sludge is delivered into a treatment container where it is mixed or tumbled while heat is applied to the material being treated, and wherein moisture gases principally water, is, drawn off and evaporated, with the treated material then being discharged from the container, and wherein one or more weight-responsive members are used to determine the solids content of the material being treated, at any given time, by measuring the difference in weight of material in the container before and after moisture is drawn off from the material.

It is another object of this invention to accomplish the above object, with or without the addition of lime or other treatment chemicals for treating material in the container.

It is another object of this invention to accomplish the above objects, wherein the treatment of the material can occur in a batch operation, a pulsed operation, or in a continuous operation.

It is a further object of this invention to accomplish the above objects, wherein the control of sewage sludge into the container and the discharge of treated material from the container, is done via a programmed computer.

It is yet another object of this invention to accomplish the above objects, wherein the weight-responsive member(s) include one or more load cells that support the container.

Other objects and advantages of the present invention will be readily apparent upon a reading of the following brief descriptions of the drawing figures, the detailed descriptions of the preferred embodiments and the appended claims.

BRIEF DESCRIPTIONS OF THE DRAWING FIGURES

FIG. 1 is an overall schematic view of an apparatus and process for practicing this invention, in which a container or drum D is shown for receiving dewatered sludge or cake from a conveyor or pump unit P that in turn, receives sewage sludge from a sludge storage silo SS, and wherein heated fluid HF is provided to the drum D, with moisture being drawn off from the drum for delivery to a scrubber condenser SC. Lime L may be provided from a lime storage silo or other chemicals CH added for delivery to the drum D. Various controls aid control lines are operated via a programmed computer C, such that the treated sludge is discharged from the drum D to a discharge conveyor DC from which the processed sludge is discharged, at a predetermined desired solids content. The processed sludge is conveyed to storage by a conveyor which may be used to cool the product before the finished product is stored in a pile or in a bulk silo.

Figure 1:
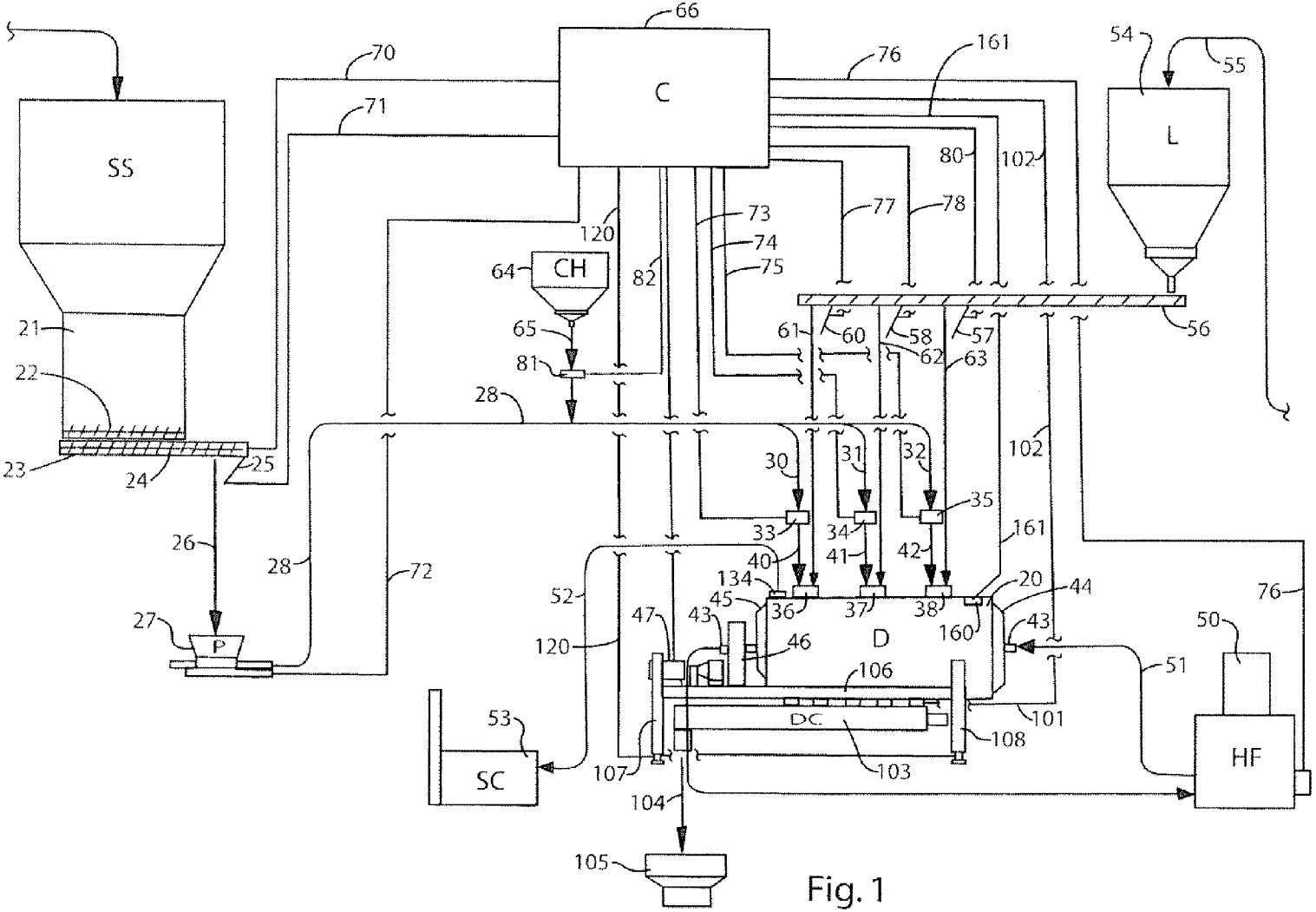
Figures 2, 2A, 2B, 2C:
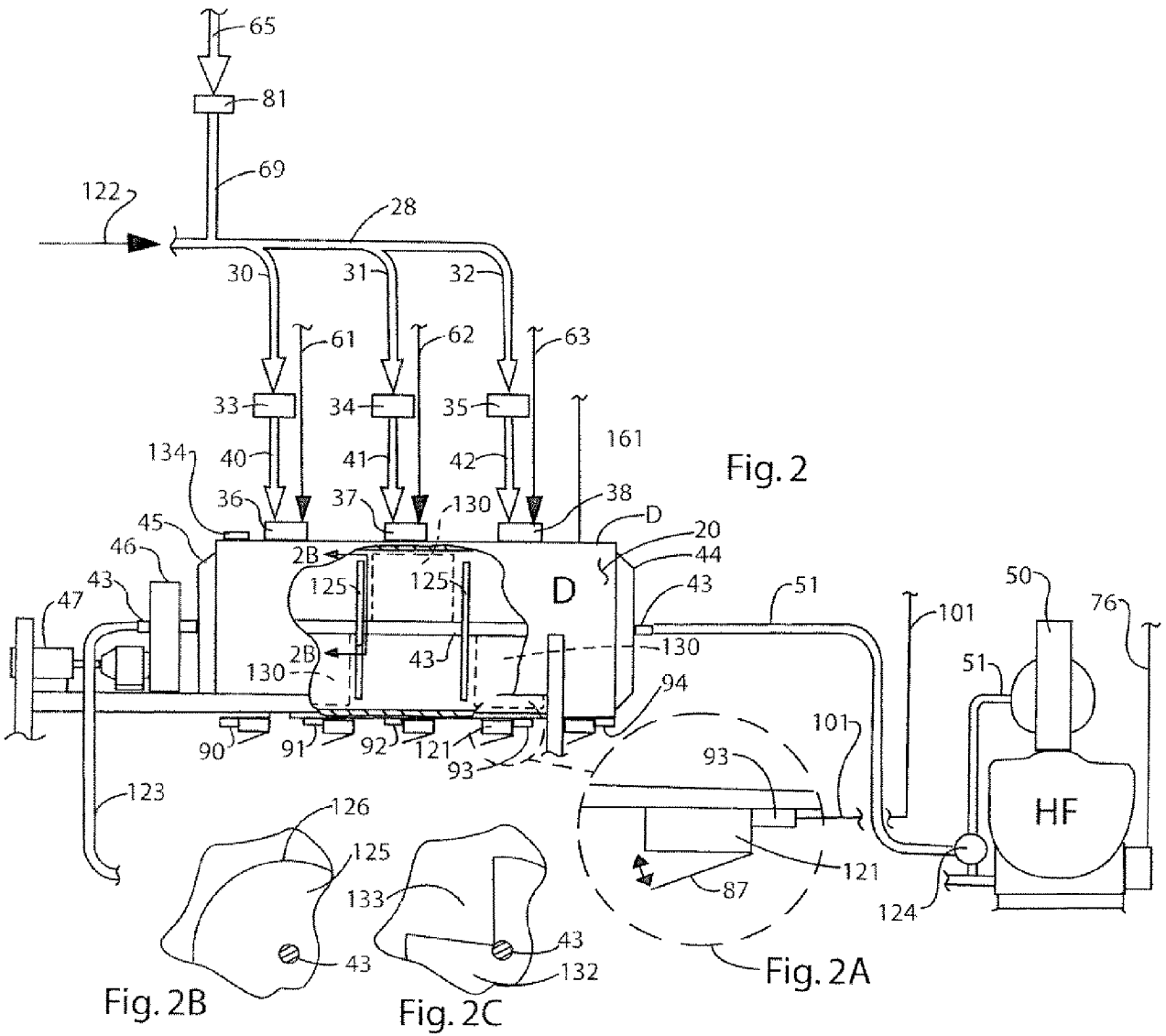
FIG. 2 is a partial schematic view of the driver unit D illustrated in FIG. 1 with a portion of the casing fragmentally broken away, to illustrate the internal components of the drum D.
FIG. 2A is an enlarged detail view of one of the openable discharge units for discharged treated product from the drum D.
FIG. 2B is a fragmentary transverse view of a portion of one of the rotatable disks from inside the drum D taken along the line 2B-2B of FIG. 2.
FIG. 2C is an illustration similar to that of FIG. 2B, but wherein one of the rotatable disks are shown having an alternative configuration to the configuration of the rotatable disk illustrated in FIG. 2B.
Figure 3:
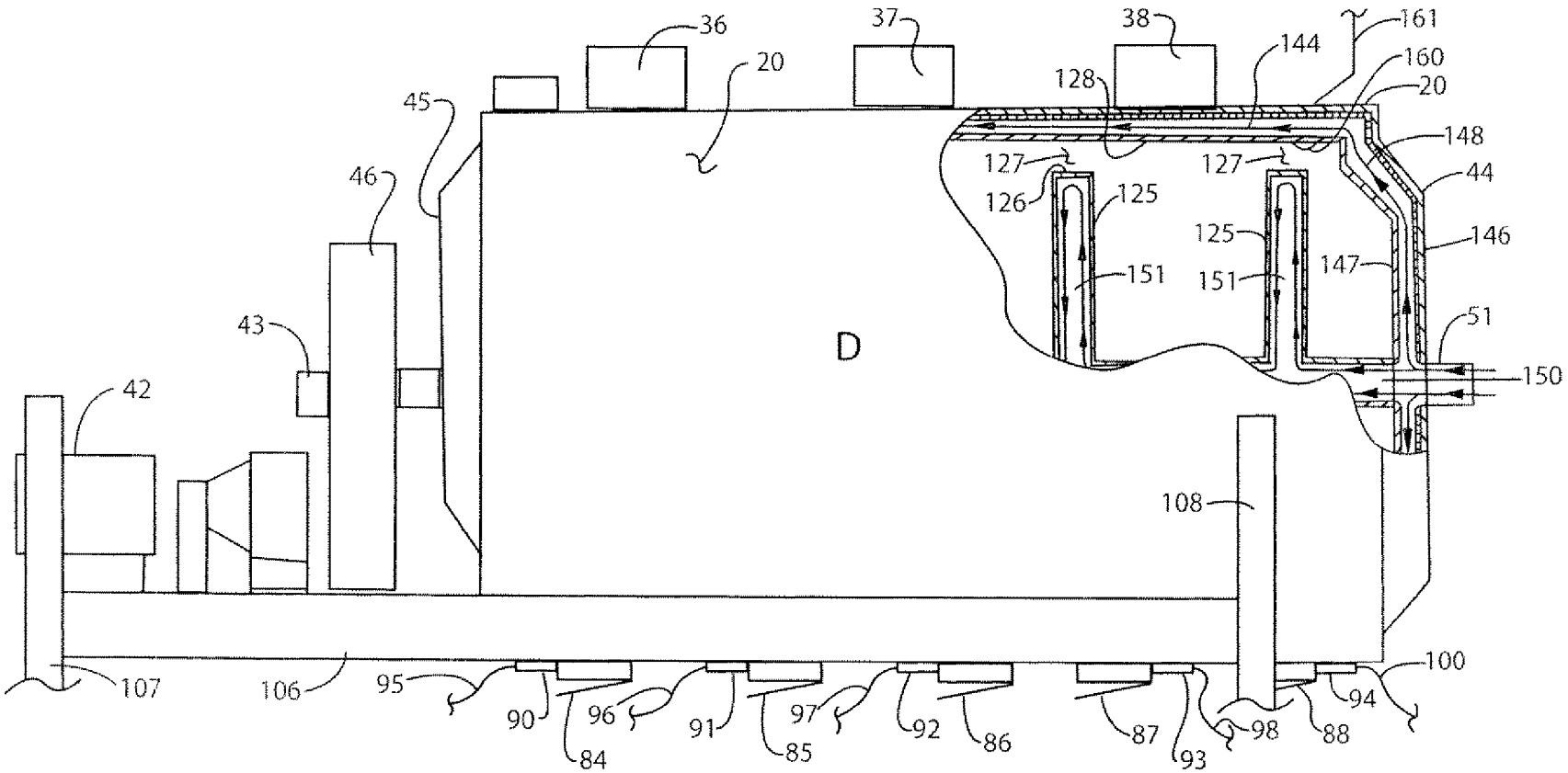

FIG. 3 is an enlarged illustration of the drum D to that illustrated in FIGS. 1 and 2, and wherein a portion of the casing of the drum is shown broken away, for clarity of illustration of the means for providing heated fluid to rotatable disks inside the drum, and between internal and external walls of the drum D, with the discharge units for discharging treated sludge from the bottom of the drum D, being more clearly illustrated.

Figures 4, 4A, 4B:
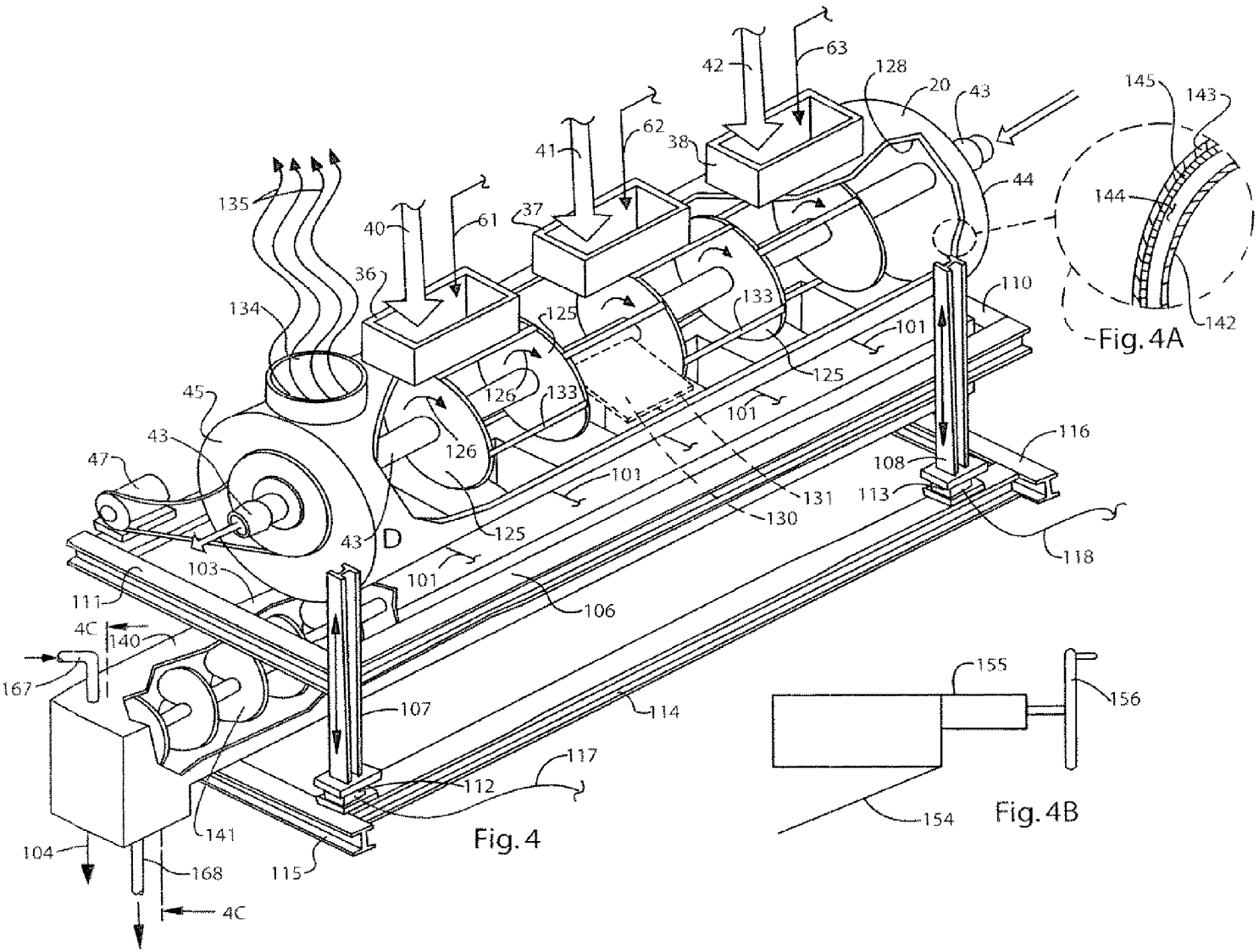

FIG. 4 is an enlarged perspective view of the drum D with the casing being shown broken away, to better illustrate the rotatable shaft and disks within the drum, and with delivery ducts for delivering sludge to be treated into the drum D also being illustrated, and with a discharge conveyor DC also being, illustrated beneath the drum D, for receiving treated sludge therefrom, and with the drum and its frame being illustrated, supported on load cells for weight measurement.

FIG. 4A is an enlarged detail view of a cross-section to the casing for the drum, showing a channel for heated fluid therein in enlarged cross-section.

FIG. 4B is an illustration of a discharge gate for discharging processed sludge from the drum D, at the bottom thereof but wherein the control for operating the discharge gate of FIG. 4B is an alternative embodiment to that of FIGS. 1, 2 and 3, being comprised of a manual control apparatus.

Figure 4C:
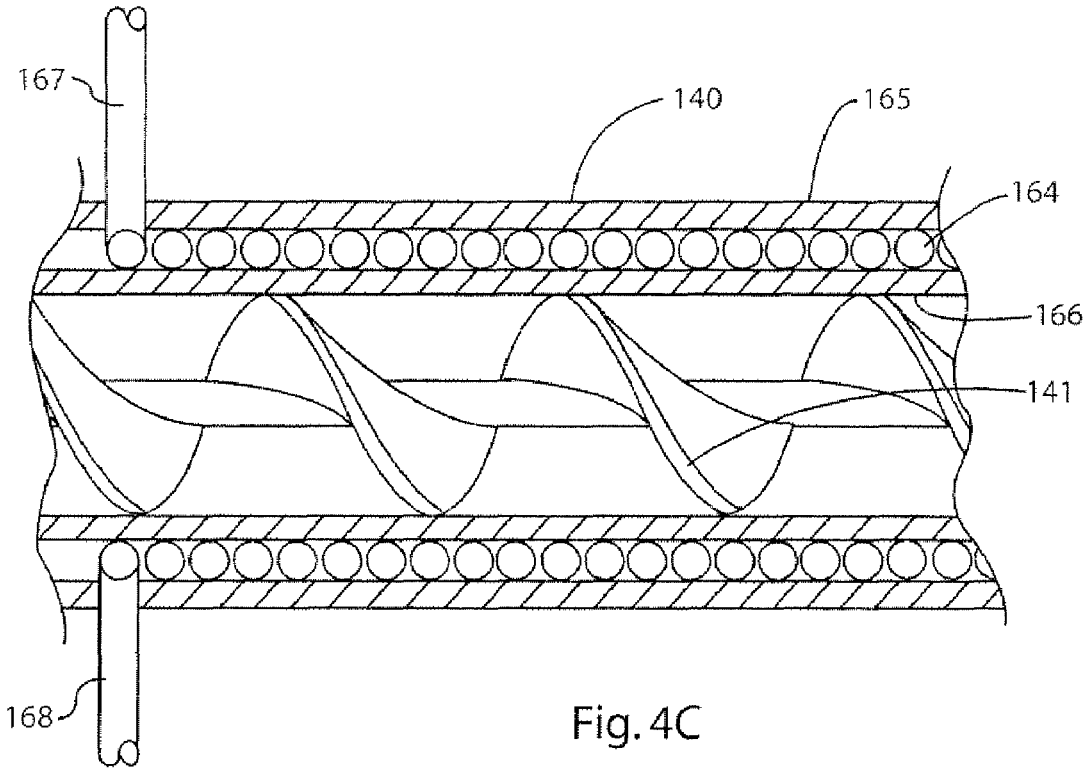

FIG. 4C is an enlarged fragmentary, longitudinal sectional view taken through the left end of the treated sludge take-off conveyor, with the illustration of FIG. 4C being taken generally along the line 4C-4C of FIG. 4.

DETAILED DESCRIPTIONS OF THE PREFERRED EMBODIMENTS

Referring now to the invention in detail, reference is first made to FIG. 1 wherein there is illustrated the drum 20, also identified by the letter "D" which functions as an evaporator of liquids, essentially water in the form of moisture.

The untreated sewage sludge is delivered via a from the sludge storage silo 21 with conveyors or a pump, also identified as "SS" in FIG. 1, having a conveyor generally designated by the numeral 22 at the bottom thereof, for delivering the untreated sewage sludge into a further cylindrical dewatering conveyor generally designated by the numeral 23, having an auger 24 therein for discharging the sewage sludge via a discharge gate 25, in the direction of the arrow 26 therefrom, into a cake pump apparatus 27, also indicated by the letter "P", from which it is pumped via delivery line 28 and its sub-delivery lines 30, 31 and 32, through respective controlled valves 33, 34 and 35, and then through entry openings 36, 37 and 38, into the drum 20, via respective delivery lines 40, 41 and 42.

The drum 20 is generally cylindrical and is horizontally situated as shown in FIG. 1, to have a horizontally disposed rotatable shaft 43 extending from the right end 44 thereof. The shaft 43 extends through the drum 44, and outwardly of the left end 45 thereof, driven via a drive pulley 46, that, in turn, is driven by a motor 47, as shown.

Heated fluid (HF) is provided via a thermal fluid heater 50, delivering the heated fluid via line 51 to the interior of the rotatable shaft 43, as will be further described hereinafter. The heated fluid, preferably oil, will provide heat within the drum 20, for heating the sewage sludge that is disposed therein for the driving off of moisture, generally water, therefrom, as the moisture evaporates from the sewage sludge. Such moisture, thus leaves the drum 20 via line 52, to be delivered to a scrubber/condenser 53, also identified as "SC" in FIG. 1. The rate of withdrawal of the air may be varied to optimize moisture removal without excessive loss of heat.

If as part of the treatment process for the sewage sludge, it is desired to add lime in some form, such may be provided from a lime storage silo also identified as "L" in FIG. 1, which periodically may have lime delivered thereto via line 55 from a lime delivery truck, or the like.

Also, while it is desired to add lime to the sludge for raising the pH of the sewage sludge, the lime may be delivered from the storage silo 54, through the bottom thereof, via a discharge auger 56, having a plurality of discharge gates 57, 58 and 60 at the bottom thereof, for discharging lime via lines 61, 62 and 63 respectively into the drum 20 via drum inlets 36, 37 and 38, respectively.

Also, if other chemicals are desired to be added to the sewage sludge, for treatment thereby, such may be provided from chemical hopper 64, also identified as "CH" in FIG. 1, to be discharged therefrom via line 65, into the drum 10 via line 28, or in any other delivery manner, preferably to enter the drum 20 via inlets 36, 37 and 38.

The entire operation can be controlled from a programmed computer 66, also identified in FIG. 1 as "C". The computer 66 can control the operation of the sewage sludge discharge conveyor 23 via control line 70, the opening of sewage sludge delivery gates 25 via line 71, the operation of the cake pump 27 via control line 72, the operation of sewage sludge delivery valves 33, 34 and 35, the operation of valve control lines 73, 74 and 75, for sludge delivery valves 33, 34, 35, respectively, as well as many other functions that will hereinafter be described.

The control of the amount and temperature of thermal fluid delivered via thermal fluid heater 50, via line 51, to the drum 20, can likewise he controlled by the computer 66, via control line 76.

The optional delivery of lime via the lime storage silo 54, when it is desired to increase the pH of the sewage sludge, for vector control or the like, to the drum 20 can be controlled from the programmed computer 66 via gate control lines 77, 78 and 80, which respectively control the gates 60, 58 and 57 for discharge of lime from conveyor 56 into the respective inlets 36, 37 and 38 of drum 20, as shown in FIG. 1.

In the event that it is desired to add additional chemicals into the drum 20 for further treatment of sewage sludge chemicals can be delivered from hopper 64 via line 65 and delivery line 28 by opening or closing a control valve 81, that, in turn, is controlled via line 82, also connected to the programmed computer 66.

Discharge from the drum 20 of dried sludge, with or without other components such as lime or other chemicals, is controlled via the operation of material discharge grates 84, 85, 86, 87 and 88, as are more clearly shown in FIG. 3, which discharge gates are in turn, controlled by suitable solenoids or other control mechanisms 90, 91, 92, 93, and 94, respectively, which in turn are controlled by control lines 95, 96, 97, 98 and 100 all of which are, in turn, controlled by control line 101 that is connected via control line 102 to the programmed computer 66.

Thus, the controlled discharge gates 84, 85, 86, 87 and 88 allow for discharge of the treated sludge into a discharge conveyor 103, also identified by the letters "DC" in FIG. 1. Then, the discharge from the discharge conveyor can pass via line 104 into a further storage silo truck or the like 105 either immediately or after being handled by intermediate conveyor devices (not shown), as shown in FIG. 1.

The treatment drum 20 is mounted on horizontal and vertical frame members 106, 107, 108, 110 and 111, as shown in FIGS. 1 and 4. Generally, the horizontal frame members are supported by four vertical frame members, such as those 107 and 108, with two mounted on each side, (front and back) of the horizontal frame members, which carry the drum 20.

The vertical frame members 107 and 108 and their corresponding vertical frame members (not shown) at the rear of the drum 20 as shown in FIG. 1, are each mounted on weight-responsive members in the form of load cells 112 and 113, that, in turn, may be mounted on a floor, or, as shown in FIG. 4, may be mounted on other floor-mounted horizontal supports 114, 115, and 116. The load cells 112 and 113 are electrically connected via control lines 117 and 118, together, and to the programmed computer 66, via control line 120. The load cells may, if desired be constructed in accordance with one or more of U.S. Pat. Nos. 5,770,823; 4,064,744; 4,166,997, 4,454,770, and 5,313,022 the complete disclosures of which are herein incorporated by reference.

With reference now to FIG. 2, it will be seen that chemicals may be added from the hopper 64 as shown in FIG. 1, via feed tine 69, to the sludge feed line 28, in the direction of the arrow 122, to pass through valves 33, 34, and 35 via sub-feed lines 30, 31, and 32 respectively to enter the drum 20 via inlet openings 36, 37 and 38 from feed lines 40, 41 and 42, as permitted by the programmed computer 66 which controls the valves 33, 34, and 35 via control lines 73, 74 and 75 as shown in FIG. 1.

Also, as shown in FIGS. 1 and 2, there is a hot oil return line 123, for returning hot oil from the drum 20 hack to the thermal fluid heater 50, through a pump 124 thereof With reference to FIG. 2A, it will be seen that a typical discharge means 121 from each of the five discharges at the lower end of the drum 120 is shown in an enlarged detail view for greater clarity.

With reference now to FIG. 2B, it will be seen that the rotatable shaft 43, disposed within the drum 20 carries generally plate-like cylindrical disks 125 mounted thereon, with the disks 125 being generally cylindrical, each having its outer periphery 126 spaced radially inwardly as shown at 127 in FIG. 3, from the inner cylindrical wall 128 of the drum 20, such spacing 127 preferably being approximately 3 inches or the like to allow for free flow of sludge material and any other ingredients entering into the drum 20 via inlets 36, 37 and 38, axially throughout the drum 20 between the ends 44, 45 of the drum, across the clearance spaces 127 radially outwardly of the disks 125. Alternatively two or more rotating shafts with disks can be used to increase the capacity of the device.

With reference to FIG. 2, it will also be seen that the rotatable shaft 43 has mounted thereon a plurality of preferably planar plates 130, shown in phantom in FIG. 2. The plates 130, as is more clearly shown in FIG. 4 are adapted to rotate with the shaft 43, and each have an outermost edge 131 that is in close, but slightly spaced relation to the inner cylindrical wall 128 of the drum 120, for scraping sludge that is being treated from the inner cylindrical wall 128, to avoid sludge build-up thereon.

The plates 130 thereby operate as a pusher means, for pushing material being treated, in a circular direction as the shaft 43 rotates.

With reference now to FIG. 2C, an alterative configuration for the shaft-mounted plates are provided each in the form of a segment of a disk 132, having a notch-out 133 therein, with the disk 132 being otherwise similarly constructed to the construction of the disk 125 of FIG. 2B. The notch-out 133 allows for additional possibilities for axial flow of material being processed throughout the drum 20, in addition to the axial flow permitted by material passing axially throughout the drum 20 via the radial spaces 127 between the peripheries 126 of the disks 125 inward of the cylindrical inner wall 128 of the drum 20.

With reference to FIG. 4, it will be seen that between the rotatable disks, in addition to or instead of the plate-like pusher means 130, there are provided rods 133 carried between and by the disks 125, for rotation therewith, as the disks 125 rotate in the direction of the arrows 126 shown therein, to additionally act as a pusher means for pushing, sludge material with or without other ingredients, and tumbling or mixing the same within the drum 20.

At the upper left end of FIG. 4, there is shown an exhaust duct 134, for carrying off gases in the form of moisture, with or without dust or the like, via representative discharge lines 135, illustrated, to represent moisture being drawn off from liquid, principally water being evaporated from sludge being processed within the drum 20. The moisture that is drawn off is provided via line 52, to the scrubber/condenser 53, illustrated in FIG. 1. The rate of removal may be varied to maximize the removal of moisture while minimizing the loss of heat or BTUs.

Mounted beneath the drum 20 the discharge or take-off conveyor 103, extending axially therealong, as shown in FIG. 4, has openings at its upper end (not shown) for receipt of dried sludge being discharged from the drum 20 through controlled discharge gates 84, 85, 86, 87 and 88 as shown in FIG. 3, through openings in the top 140 of the discharge conveyor 103. Inside the discharge conveyor, is a generally helically disposed auger shaft-mounted as shown at the left end of FIG. 4, for axial conveyance of treated sludge therealong, to be discharged therefrom, as shown via discharge line 104 as described above with respect to FIG. 1.

With reference now to FIG. 4A, an enlarged cross-sectional detail of the cylindrical wall of the drum 20 is shown as including an inner wall 142 and an outer wall 143 spaced therefrom, defining a generally cylindrical space 144 therebetween. Optionally, a layer of insulation 145 may be provided at, or as part of the outer wall 143, to preserve heat within the drum 20.

With reference to FIGS. 4A and 3, it will be seen that heated fluid, preferably oil provided from the thermal fluid heater 50 is provided via line 51, between hollow end wall portions 146 and 147, to enter into the cylindrical zone 144 described above, in the direction of the arrow 148. Simultaneously, heated oil passes through the rotating shaft 150 to enter into the interiors 151 of the disks, to heat the exterior surfaces of the disks which will then engage sludge that is being processed therein, to transfer heat to the sludge, for evaporation of moisture therefrom, drying the sludge, with the moisture then passing out through the exhaust port 134 of the drum 20, and to the scrubber/condenser 53, via line 52, as described above.

In FIG. 4B, there is shown an alternative embodiment for the gates 84, 85, 86, 87 and 88 of FIG. 3, in the form of a discharge gate 154 having a solenoid or other control 155, which is operated by a hand crank 156 or the like, for manually opening the gates 154, instead of the manner described above with respect to the gates of FIGS. 1-3, which are controlled by the programmed computer 66.

A plurality of temperature sensors 160 may be present in the drum 20 for sensing the temperature at various locations therein, as the sewage sludge is being mixed or tumbled, and delivering that information via control line 161 to the computer 66, for determining if the desired temperature, for example 72° C. is reached for a desired period of time, for example at least 20 minutes, for providing information about the rate of evaporation of moisture, generally water from the sewage sludge being treated.

With reference now to FIG. 4C, as taken at the left end of the take-off auger conveyor 140, it will be seen that a cooling means is provided for the take-off conveyor 140, for cooling treated sludge in the take-off conveyor 140. The cooling means can be of any type, but may, for example, be in the form of a continuous, spiral wound tubing 164, between outer and inner walls 165, 166 of the take-off conveyor 140, with suitable water feed and discharge lines 167 and 168, respectively, for cooling the treated sewage sludge that has been discharged from the drum 20, as it is passed through the take-off conveyor 140 by means of the shaft-mounted helical auger.

Operation

In operation, the sewage sludge that is stored in the silo 21 is withdrawn therefrom by means of the generally hellical conveyor 22 at the bottom thereof, and enters into a preferably dewatering conveyor 23, also preferably having a generally helical auger therein, for discharging sewage sludge therefrom, via the discharge gate 25, with the sludge then being delivered via line 26 to the cake pump apparatus 27, from which it is pumped via line 28 and its sub-delivery lines 30, 31 and 32 through valves 33, 34 and 35 that are operated by the computer 66, to deliver the sewage sludge into the drum 20, through entry openings 36, 37 and 38. If lime treatment is desired lime can be provided from a storage bin 54 that has been supplied from a truck or the like via line 55 with the lime then being discharged via an auger type conveyor 56, through gates 57, 58 and 60, to be provided into the drum via lines 61, 62 and 63.

If additional or different chemicals are desired to be added to the sewage sludge for treatment, they can be provided from a chemical hopper 64 via line 65 into sludge intake line 28, or, alternatively, directly into the drum 20 (not shown).

As with the cake pump 27 that has a control line 28, and as with the gate 25 having a control line 71, and as the valves 33, 34 and 35 are controlled via lines 73, 74 and 75, respectively, from the computer 66, so is the valve 81 controlled via line 82 from the computer 66.

A heat medium, preferably heated oil, is provided from a thermal fluid heater 50, via line 51 into the center of the shaft 43 of the drum 20, with the heated oil heating the hollow center of the shaft 51 within the drum 20, as well as heating the interiors 151 of the disks 125, in order to maximize the surface area of the heated portions of the drum 20, to maximize the opportunity for sewage sludge containing either no additional materials, or containing lime or other chemicals, for maximum contact with heated surfaces, to facilitate and maximize the evaporation of moisture therefrom.

When sludge is delivered into the drum 20 via inlets 36, 37 and 38, it has an opportunity to pass axially, or longitudinally through various portions of the drum, because of the spacing 127 between the outer peripheries of the disks 125 and the inner cylindrical surface 128 of the drum.

Also, within the drum 20, pusher means in the form of the plates 130 described above and/or the rods 133, facilitate tumbling and pushing and otherwise mixing the sewage sludge within the drum 20. Furthermore, the generally radially disposed plates 130 facilitate the prevention of accumulation of sewage sludge on the inner surface of the cylindrical wail 128 of the drum, because such run in close clearance to the inner surface 128.

One or more sensors 160 can sense the temperature of sewage sludge within the drum 20 and communicate the same via line 161, back to the computer 66 to signal to the computer the temperature of the sludge at any given time, or when the sludge temperature has reached a desired predetermined level.

As moisture is evaporated from the sludge within the drum, such is drawn off via discharge vent 134 through line 52 to the scrubber/condenser 53, which will neutralize fumes, dust and the like that is drawn off from the drum 20 during the treatment of the sludge.

The drum 20 is mounted on a plurality of weight-responsive members 112, 113 (preferably comprising four such members), which weight-responsive members are preferably load cells. The load cells communicate the weight of the drum and its framing structure, including the weight of sludge entering the drum before and after water is removed, and in fact such load cells communicate changes in weight on a continuous basis back to the computer 66.

When a predetermined desired solids level is reached within the drum 20, the computer 66 signals the opening of discharge gates 84, 85, 86, 87 and 88 for the discharge of treated sludge from the drum 20, into the take-off conveyor 103, through the top 140 thereof, wherein the dried sludge is delivered through the cooled discharge conveyor which can be cooled in the manner set forth in FIG. 4C, with the helical screw auger 141 delivering the dried and treated sludge material from the left-most end of the discharge conveyor 103, as shown at 104, into a storage silo or the like, or even a truck for carrying the same away, as shown at 105.

As an alternative to the computer control, if manual operation is desired, such can be done via manual control of discharge gates 154 via a manually operated hand crank 156, or the like.

Thus, in accordance with the present invention, the process described herein effectively stabilizes sewage sludge by greatly reducing disease carrying pathogens and minimizes the potential for transmission of pathogens by reducing the potential for vectors to be attracted to the finished product. The end product can be further conditioned to reduce the moisture content, in effect reducing the volume of product that needs to be transported and disposed.

The process environment is essentially sealed to minimize undesirable emissions. The end product is thereby conditioned to further reduce emissions and dusting, and is a product of relatively uniform size and consistency.

The cooling of the end product in the take-away conveyor 103, serves to minimize the release of both steam and ammonia and also results in a hardening of the finished product that enhances its friability and enables the sizing of the product to produce a product with nominal or no odors, of uniform size, and having a granular consistency.

The use of load cells or other weight-responsive members provides a means to measure weight gravimetrically, to monitor the weight of the contents of the drum so that through simple mathematical calculations, preferably performed by the computer a predetermined solids concentration of the contents of the drum can be accurately and repeatedly produced.

The process can be practiced either in a batch operation, a pulsed operation, or in a continuous operation.

In a batch operation, the computer will control the delivery of sludge to be processed into the drum, and after a predetermined time, or when the heat sensors in the drum signal the computer to having reached a predetermined heat level, the gates at the bottom of the drum will be opened automatically as dictated by the computer, to discharge treated sludge to the take-away conveyor.

In a pulsed or semi-continuous mode, the system can be operated such that a predetermined amount of material is added to the drum and, subsequently, as the initial material is reduced in weight through evaporation, as noted by the load cells or other weight-responsive means, the computer can signal the opening of appropriate valves for introduction of additional material into the drum.

Additionally, in a continuous operation, as the load cells repeatedly record the weight of material in the drum and signal the computer accordingly a rate of evaporation is established, enabling the computer to set a feed rate and operate the inlet valves that supply sewage sludge to the drum at a continuous rate.

Thus there is presented a system tot thermal stabilization of sewage sludge followed by additional moisture reduction that produces a predetermined end product concentration that can be between 10% and 99% solids. The system delivers a sludge cake to the drum, in which sewage sludge is thermally processed, with optional chemical treatment by lime or other chemicals. The resultant dried product, having a solids concentration that can be predetermined to be between 10% and 99% dry, is thereby produced. The gas scrubbing can eliminate or at least very substantially reduce noxious odors.

The system described herein stabilizes sludge in a virtually sealed environment, which helps to control offensive odors, withdrawn gasses and particulates while allowing the operator the flexibility to produce a friable end product that is more preferably between 50% and 99% dry solids.

The system can also be manually operated, as described above.

If it is desired in operating the system to produce a finished product having a concentration for example between 75% and 99% dry solids, the sewage sludge will be retained within the drum or thermal reactor for a period of time, adding heat until the final product's solids concentration reaches the predetermined desired concentration.

When it is desired to also treat the sewage sludge with lime, sufficient lime is added to raise the pH of the sewage sludge to above 12.0 for a predetermined period of time, to further reduce vector attractiveness, and enhance the stability of the finished product, even at a lower solids concentration than that described above.

To the extent that the addition of heat and chemicals may result in the generation of gasses and particulates, such can be removed by the scrubber 53.

Thus, an apparatus, process and system is provided for stabilizing sewage sludge, wherein an inventory of sludge is accumulated at some known or estimated solids concentration, prior to being fed into the evaporator drum. The sewage sludge is thus initially fed into the reactor drum, heat is applied and as moisture is removed, additional sewage sludge is then added to the drum. After stabilization has been completed, additional conditioning may be accomplished through further moisture reduction cooling, size reduction and eventually the conveying of the solids to storage, The off gasses are conditioned to remove any objectionable characteristics. The stabilization of the sewage sludge is thus achieved through thermal conditioning. The sludge is heated in the evaporator drum to or above a predetermined temperature, for a predetermined time until a predetermined solids concentration between 45% and 99% dry solids is achieved. Alternatively, the stabilization of the sewage sludge is achieved through the thermal conditioning to or above a predetermined temperature for a predetermined period of time and chemical(s) are added to stabilize the sewage sludge at lower solids concentrations.

The contents of the evaporator drum are monitored through the use of mathematical formulas, which may be further enhanced through data that is accumulated from the load cells or other gravimetric devices, to control the stabilization process or system.

In drawing off moisture, such can be done at a variable rate which maximizes the moisture removed, while not removing excessive heat from the drum.

In accordance with this invention, the system provides an economical method of stabilizing sewage sludge that can be fully automatic, thus enabling the system to take advantage of off-peak energy rates and processing which system can be operated in an unattended manner, thereby also reducing the costs of manpower.

It will be apparent form the foregoing that various modifications may be made in the apparatus described above, as well as in the process steps, as may suggest themselves to those skilled in the art, upon a reading of this specification, all within the spirit and scope of the present invention as defined in the appended claims.

What is claimed is:

1. Apparatus for treating sewage sludge having a moisture content by drying and/or pasteurizing and/or otherwise chemically treating material comprising sludge and any added ingredients comprising:

(a) a drum;

(b) sewage sludge delivery means connected to the drum for delivering sewage sludge with a moisture content to the drum;

(c) means for tumbling the material within the drum;

(d) means for heating the material in the drum;

(e) exhaust means for drawing off moisture gases being evaporated from the material in the drum;

(f) discharge means for discharging the treated material from the drum;

(g) at least one weight-responsive member on which the drum is mounted;

(h) control means connected to said weight-responsive member(s), whereby the solids content of the treated material can be determined by measuring the difference in weight of the drum with the material in the drum, before and after moisture is drawn off from the material, prior to discharge of treated material from the drum.

2. The apparatus of claim 1, including programmed computer means as part of said control means connected to said delivery means and said discharge means, for treating sewage sludge in a batch operation.

3. The apparatus of claim 1, including programmed computer means as part of said control means connected to said delivery means and said discharge for treating sewage sludge in a pulsed operation.

4. The apparatus of claim 1, including programmed computer means as part of said control means connected to said delivery means and said discharge means, for treating sewage sludge in a continuous operation.

5. The apparatus of claim 1, wherein the drum is stationary, and has a rotatable shaft therein, with a plurality of rotatable plates therein carried by the shaft for engaging material in the drum and facilitating the tumbling of the material, including means for rotating the shaft.

6. The apparatus of claim 5, wherein the means for heating the material in the drum includes means for heating the plates.

7. The apparatus of claim 5, wherein the stationary drum has a generally cylindrical inner wall.

8. The apparatus of claim 5, wherein the plates are generally disk-like.

9. The apparatus of claim 5, wherein the plates comprise segments of a disk.

10. The apparatus of claim 5, wherein the shaft and plates are generally hollow, with means for applying heat thereto.

11. The apparatus of claim 10, wherein the means for applying heat comprises duct means for delivering heated fluid thereto.

12. The apparatus of claim 7, wherein the plates have peripheries that are spaced from the cylindrical inner wall of the drum.

13. The apparatus of claim 5, wherein there are provided material pusher means disposed between adjacent plates for mixing material in the drum by pushing material as the plates and shaft rotate in the drum.

14. The apparatus of claim 7, wherein there are provided material pusher means disposed between adjacent plates for mixing material in the drum by pushing material as the plates and shaft rotate in the drum, wherein the pusher means comprise generally planar ribs between adjacent plates for rotation therewith in close proximity to the cylindrical inner wall of the drum, for scraping material from the cylindrical inner wall of the drum.

15. The apparatus of claim 7, wherein there are provided material pusher means disposed between adjacent plates for mixing material in the drum by pushing material as the plates and shaft rotate in the drum, wherein the pusher means comprise rods disposed between adjacent plates, for rotation therewith.

16. The apparatus of claim 1, including lime delivery means for optionally delivering lime as an added ingredient to the drum for optionally pasteurizing the sludge, and wherein the sludge delivery means and the lime delivery means are independently operated by said control means.

17. The apparatus of claim 1, including means for delivering chemicals for chemical treatment of sludge in the drum, and wherein the sludge delivery means and the means for delivering chemicals are independently operated by said control means.

18. The apparatus of claim 1, wherein said exhaust means includes a scrubber for treating gases drawn off the material being treated.

19. The apparatus of claim 1, wherein the discharge means includes a plurality of discharge gates and means for operating the discharge gates.

20. The apparatus of claim 19, wherein the discharge means include a discharge conveyor disposed for receiving material discharged via the discharge gates.

21. The apparatus of claim 1, wherein said at least one weight-responsive member includes a plurality of load cells supporting said drum.

22. The apparatus of claim 1, wherein the control means includes a computer for controlling said delivery means and said discharge means, as a function of the determination of solids content of the treated material via said at least one weight-responsive member.

23. The apparatus of claim 1, wherein said control means includes manual means for controlling said delivery means and said discharge means as a function of the determination of solids content of the treated material via said at least one weight-responsive member.

24. The apparatus of claim 5, wherein the drum has a generally cylindrical inner wall, wherein the plates arc generally disk-like, wherein the shaft and plates are generally hollow, with means for applying heat thereto, wherein there are provided material pusher means disposed between adjacent plates for mixing material in the drum by pushing material as the plates and shaft rotate in the drum, wherein the discharge means includes a plurality of discharge gates and means for operating the discharge gates, wherein the discharge means include a discharge conveyor disposed for receiving material discharged via the discharge gates and wherein said at least one weight-responsive member includes a plurality of load cells supporting said drum.

25. A method of treating sewage sludge having a moisture content by drying and/or pasteurizing and/or otherwise chemically treating material comprising sludge and any added ingredients comprising:

(a) providing a drum;
(b) delivering sludge with a moisture content to the drum;
(c) tumbling the material within the drum;
(d) heating the material in the drum;
(e) drawing off moisture gases being evaporated from the material in the drum;
(f) discharging the treated material from the drum;
(g) providing at least one weight-responsive member on which the drum is mounted;
(h) measuring the difference in weight of the drum with the material in the drum via the at least one weight responsive member, before and after moisture is drawn off from the material, prior to discharge of treated material from the drum, whereby the solids content of the treated material can be determined.

26. The method of claim 25, wherein said delivering and discharging steps include treating sewage sludge in a batch operation.

27. The method of claim 25, wherein said delivering and discharging steps include treating sewage sludge in a pulsed operation.

28. The method of claim 25, wherein said delivering and discharging steps include treating sewage sludge in a continuous operation.

29. The method of claim 25, wherein the drum is maintained stationary, and rotating a rotatable shaft therein, with a plurality of rotatable plates therein carried by the shaft and engaging material in the drum and facilitating the tumbling of the material.

30. The method of claim 29, and heating the material in the drum by heating the plates.

31. The method of claim 30, wherein the heating of the plates comprises delivering heated fluid through ducts in the plates.

32. The method of claim 29, wherein the tumbling step includes mixing the material in the drum by pushing material as the plates and shaft rotate in the drum.

33. The method of claim 32, including the step of scraping material from a cylindrical inner wall of the drum.

34. The method of claim 25, including optionally delivering lime as an added ingredient to the drum for optionally pasteurizing the sludge.

35. The method of claim 25, including delivering chemicals for chemical treatment of sludge in the drum.

36. The method of clam 25, wherein the drawing off step includes scrubbing gases drawn off the material being treated.

37. The method of claim 25, wherein the discharging step includes opening a plurality of discharge gates.

38. The method of claim 37, wherein the discharging step includes providing a discharge conveyor disposed for receiving material discharged via the discharge gates.

39. The method of claim 25, wherein the step of providing at least one weight-responsive member includes providing a plurality of load cells supporting said drum.

40. The method of claim 25, including the step of controlling said delivering and discharging steps as a function of the determination of solids content of the treated material via said at least one weight-responsive member, through a computer.

41. The method of claim 25, including the step of manually controlling said delivering and discharging steps as a function of the determination of solids content of the treated material via said at least one weight-responsive member.

42. A system for treating sewage sludge having a moisture content, comprising a sludge storage silo, means for conveying sewage sludge with a moisture content from the silo into a treatment drum, means for tumbling the sludge within the drum, means for heating the sludge in the drum to evaporate moisture from the sludge, means for drawing off moisture gases from the sludge in the drum, means for discharging sludge from the drum into a take-off conveyor, means for conveying treated sludge through the discharge conveyor into a hopper, a hopper for receiving sludge from the discharge conveyor, at least one weight-responsive member on which the drum is mounted, and control means connected to the weight-responsive member(s), whereby the solids content of the treated material can be determined by measuring the difference in weight of the drum and the material in the drum, before and after moisture is drawn off from the material, prior to discharge of treated material from the drum.

43. The system of claim 42, wherein the control means includes a programmed computer.

44. The system of claim 42, including a gas scrubber for treating moisture drawn off from the drum, connected to the drum for receiving moisture therefrom.

45. The system of claim 42, including a thermal fluid heater, for heating a medium that in turn supplies heat to the drum for heating components thereof for evaporating moisture from sludge in the drum.

46. The system of claim 42, including means associated with said take-off conveyor for cooling sewage sludge in the take-off conveyor that has been delivered thereto from the drum.

47. The system of claim 42, including a lime storage silo and means for delivering lime from the silo, into the drum.

48. The system of claim 42, including means for storing chemicals, and delivery means for delivering chemicals from the storage means, into the drum, for assisting in the treatment of sewage sludge in the drum.

49. The system of claim 42, wherein the control means includes a programmed computer, including a gas scrubber for treating moisture drawn off from the drum, connected to the drum for receiving moisture therefrom, including a thermal fluid heater, for heating a medium that in turn supplies heat to the drum for heating components thereof for evaporating moisture from sludge in the drum, including means associated with said take-off conveyor for cooling sewage sludge in the take-off conveyor that has been delivered thereto from the drum, including means for storing chemicals, and delivery means for delivering chemicals from the storage means, into the drum, for assisting in the treatment of sewage sludge in the drum.

* * * * *

UNITED STATES PATENT AND TRADEMARK OFFICE

CERTIFICATE OF CORRECTION

PATENT NO. : 7,669,348 B2
APPLICATION NO. : 11/539903
DATED : March 2, 2010
INVENTOR(S) : Christy et al.

It is certified that error appears in the above-identified patent and that said Letters Patent is hereby corrected as shown below:

Column 1 line 18, "5,681,48" should read -- 5,681,481 --.

Column 1 line 29, "junction" should read -- function --.

Column 2 line 56, "aid" should read -- and --.

Column 4 line 27, "drum 10" should read -- drum 20 --.

Column 5 line 29, "tine" should read -- line --.

Column 9 line 18, "tot" should read -- for --.

Column 11 claim 24, line 64, "arc" should read -- are --.

Signed and Sealed this

First Day of June, 2010

David J. Kappos

David J. Kappos
*Director of the United States Patent and Trademark Office*